United States Patent [19]

Litrap

[11] 4,289,241

[45] Sep. 15, 1981

[54] GOLD PAN AND CLASSIFIER

[76] Inventor: Jay J. Litrap, 3207 Belvidere SW., Seattle, Wash. 98126

[21] Appl. No.: 128,514

[22] Filed: Mar. 10, 1980

[51] Int. Cl.[3] ..... B07B 1/32

[52] U.S. Cl. ..... 209/44; 209/447; 209/506

[58] Field of Search ..... 209/44, 155, 315, 237, 209/417, 418, 445–450, 487, 506

[56] References Cited

U.S. PATENT DOCUMENTS

| | | | |
|---|---|---|---|
| 585,989 | 7/1897 | Sletcher | 209/447 |
| 634,120 | 10/1899 | Moore | 209/447 |
| 760,691 | 5/1904 | Herndon | 209/447 |
| 840,333 | 1/1907 | Hussex | 209/447 |
| 865,178 | 9/1907 | Hardwick | 209/447 |
| 1,444,752 | 2/1923 | Ord | 209/447 |
| 2,122,822 | 7/1938 | Noel | 209/448 |
| 3,899,418 | 8/1975 | Lawrence et al. | 209/447 |
| 4,162,969 | 7/1979 | Lagal | 209/447 |

*Primary Examiner*—William A. Cuchlinski, Jr.
*Attorney, Agent, or Firm*—Christensen, O'Connor, Johnson & Kindness

[57] ABSTRACT

A gold panning and classifying method and system includes a generally rectangularly shaped gold pan having diverging side panels and a plurality of valleys and ridges in the front panel. A plurality of nesting classifying screens are included to effect a first separation of material into portions composed of equivalent size particles. The unique shape of the pan greatly enhances the gravity separation techniques for separating fine sands from gold and gold dust.

25 Claims, 15 Drawing Figures

Fig. 2.
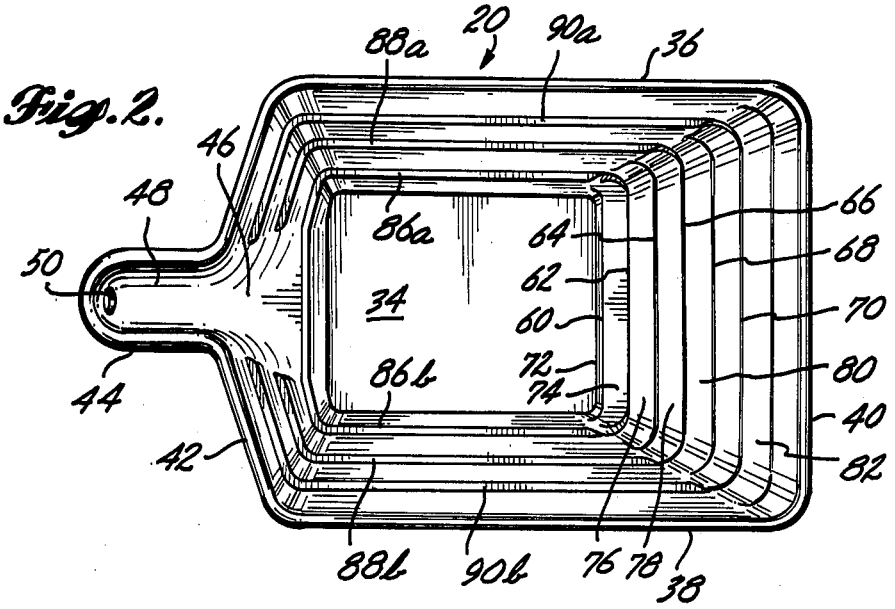
Fig. 3.
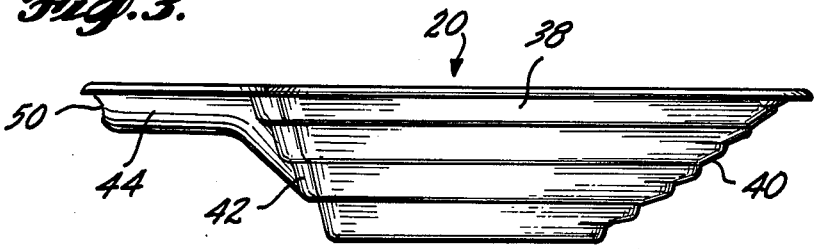
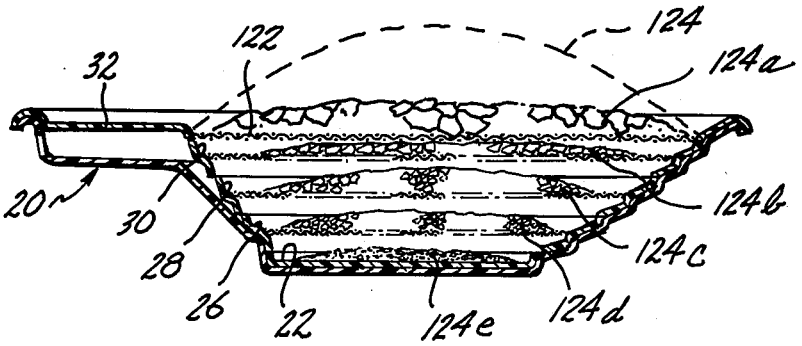
Fig. 4.

GOLD PAN AND CLASSIFIER

BACKGROUND OF THE INVENTION

The present invention relates to apparatus and methods for the separation of a first granular material from a second granular material having a specific gravity less than the first granular material, and more specifically to methods and apparatus for separating gold dust and nuggets from sand, gravel, and other material with which gold dust and nuggets are normally associated in nature, and most particularly to such methods that can be implemented by hand.

Prior art gold panning techniques call for the use of a rounded, shallow container, normally referred to as a gold pan. Gold pans are available in a variety of rounded shapes; however, most are circular in plan view and have a relatively flat bottom from which the rounded sidewalls are uniformly upwardly and outwardly flared. Gold is separated from gold-containing gravel and sand; for example, by placing the mixture into a pan and vibrating the mixture in the pan so that, theoretically, the gold, which is the heavier material present, settles to the bottom. The top, or lighter, materials are then washed from the pan by causing the water in the pan to pass over the material in the pan and allowing the water after it has passed over the material to flow over the lip or edge of the pan, carrying with it some of the lighter material. When necessary, the water is replenished and the procedure repeated until all of the gravel and sand is washed away, leaving only gold. This technique has been utilized for gross separations of materials as well as for separating gold dust from the fine, black sands of no value.

The drawback to the prior art methods is that, as the water travels across the circular, flat bottom of the pan and approaches material normally placed at the intersection of the flat bottom and the rounded sides, the rounded sides tend to cause the water to converge on itself, in essence, pinching the sand and gold together. As the pinching effect occurs, there is a tendency for the sand and gold to mix and for the sand to be removed to a greater depth on the sides of the sand and gravel mass than occurs in the middle of the mass. As more and more of the black sand is removed, one of ordinary skill will readily see that the uneven removal of black sand and the mixture of the sand and gold will eventually lead to removal and thus loss of gold from along the sides of the mass. This and other drawbacks thus limit the utility and efficacy of prior panning techniques for final separation of small amounts of black sand from small amounts of gold dust. Accordingly, other separation techniques have been resorted to, including amalgamation. However, these other techniques all have their drawbacks and to some extent lead to the loss of certain amounts of gold dust.

Another drawback to prior art panning techniques is that sand, gravel, and gold are usually mixed together often in aggregate sizes that vary from each other significantly. Conventional panning techniques utilized to separate large granular materials from small granular materials result in the loss of some gold because sand particles, although having a lesser specific gravity than gold particles, tend to move through a mixture under the influence of gravity at a greater velocity than grains of gold. However, when granular materials of substantially similar size are placed together in a pan, the gold will quickly settle to the bottom upon vibration of the materials in the presence of water.

It is therefore a broad object of the present invention to provide methods and apparatus that employ panning techniques, but that enable one to effectively, efficiently, and almost completely separate fine granular material such as black sand from gold dust using techniques that are akin to, but different from, prior art panning techniques. It is a further object of the present invention to provide apparatus for retrieving gold from a pan once it has been separated from other granular material. It is a further object of the present invention to provide apparatus that can be utilized for the classification of sands and accompanying gold dust and nuggets into its component sizes so that materials of like size can be processed separately from materials of smaller or larger size. It is a further object of the present invention to provide an integrated classifying and panning system that can be compactly shipped and stored and that can be easily used, even by those who are neophytes to the panning arts.

SUMMARY OF THE INVENTION

In accordance with the foregoing objects, and other objects that will become apparent to one of ordinary skill, the present invention first provides a method for separating a mixture of a first granular material and a second granular material having a specific gravity less than the first material. The method comprises three steps. First, the mixture is confined in a trough-shaped container in a generally elongated mass. The mass has a relatively flat upper surface and a longitudinal axis. The apex of the mass is positioned below the relatively flat upper surface. Secondly, the mixture is covered with water and vibrated in the container so as to cause the first material to settle, leaving the second material adjacent the flat upper surface of the mass. Thereafter, the water is confined over and adjacent the mass so that as the container is rocked back and forth about the longitudinal axis of the mass, the water alternately runs off the mass in a layer having a substantially uniform depth along the longitudinal extent of the mass, and runs over the mass in a layer having a relatively uniform depth along the longitudinal extent of the mass. By rocking the mass about its longitudinal axis the water is caused to run in a direction transverse to, and preferably orthogonal to, the axis. Thus, each time the water runs off the mass, a layer of the second material adjacent the upper surface of the mass is removed in a uniform layer and carried away from the mass. This process is repeated until all or substantially all of the second material is removed or separated from the first material.

A container useful for performing the foregoing method comprises a generally rectangular base portion, a pair of side panels, a front panel and a rear panel. The base portion has a forward end and a rearward end and has its longitudinal dimension lying in the fore and aft direction. The side panels are joined to and extend divergently upwardly from opposite longitudinal sides of the base. The front panel is joined to and extends upwardly and forwardly from the front end of the base. The front panel increases in width as it extends upwardly in proportion to the divergency of the side panels. The forward edge portions of the side panels are joined to respective ones of the side edge portions of the front panel. The rear panel extends upwardly from the rearward edge of the base and increases in width as it extends upwardly in proportion to the divergency of the side panels. The side edge portions of the rear panel are joined to respective rearward edge portions of the side panels. Most preferably, the front panel further comprises a plurality of ridges and valleys that extend across the width of the front panel. Each of the valleys has a substantially constant depth relative to an adjacent ridge. The ridge lines of the ridges are substantially parallel to each other and to the corner junction between the front panel and the base. Preferably, the ridges and valleys extend from adjacent the base to adjacent the upper end of the front panel.

In another aspect, the present invention provides a panning and classifying system for classifying granular material and for separating at least a first granular material from a second granular material having a specific gravity less than the first material. The system comprises a pan and a plurality of nesting trays. The pan has a rectangular base, upwardly diverging side panels, an upwardly and forwardly extending front panel, and an upwardly and rearwardly extending back panel, all constructed and joined so as to form an upwardly opening container. The back panel has a rearwardly extending handle connected thereto, preferably adjacent the upper edge thereof. The front panel has a plurality of spaced ridges and valleys the ridge lines of which extend across the front panel in a generally parallel relationship to the junction of the front panel and the base. At least one of the rear panel and the side panels has a plurality of tray-supporting shoulders. The tray-supporting shoulders are oriented generally parallel to the base. The tray-supporting shoulders are spaced from the base by distances corresponding to the distances that at least some of the ridge lines are spaced from the base so that the ridges and shoulders cooperate to form a plurality of tray supports. The tray support nearest the base has the smallest exterior dimension, while those spaced from the base have increasing exterior dimensions in proportion to the distance from the base. Each of the trays is sized to rest in nesting relationship on one of the plurality of tray supports. The trays include a tray frame and a bottom screen. The tray nearest the base has a bottom screen with the smallest screen openings. The openings in the screens associated with the remaining trays have an increased size in proportion to the respective increase in spacing of the remaining trays from the base.

DETAILED DESCRIPTION OF THE DRAWINGS

A better understanding of the present invention can be derived by reading the ensuing specification in conjunction with the accompanying drawings wherein:

FIG. 2 is a plan view of the pan of the present invention;

FIG. 3 is a side elevation view of the pan of the present invention;

FIG. 4 illustrates the sequence of material classification utilizing the panning and classifying system in accordance with the present invention;

FIGS. 5 through 8 are a series of views of the pan in partial cross section showing material to be separated in the pans and showing the sequence of accomplishing a preliminary separation in accordance with the present invention; and FIGS. 9 through 15 are a series of views of the pan in partial cross section showing the sequence of steps employed in accordance with the backpanning aspect of the present invention.

DETAILED DESCRIPTION OF THE INVENTION

Figure 1:
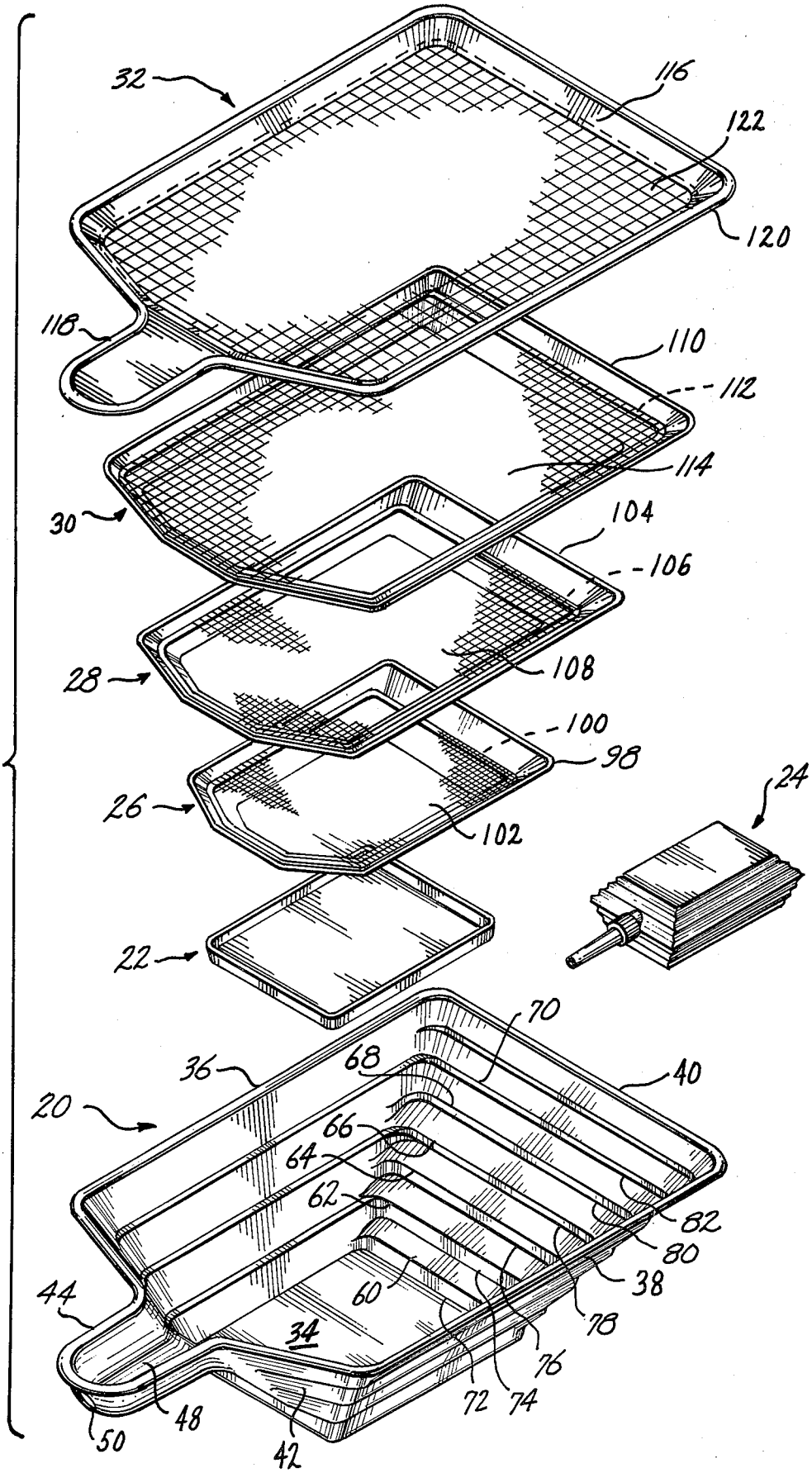
FIG. 1 is an exploded isometric view of the panning and classifying system of the present invention including the pan and a plurality of classifying trays and screens.

Referring conjunctively to FIGS. 1, 2, and 3, the panning and classifying system of the present invention includes a pan, generally designated 20, a tray 22, a collapsible bottle 24, and classifying screen trays 26, 28, 30, and 32. In its commercial embodiment the system includes two pans 20, the tray, collapsible bottle, and one set of classifying screens. In this form, one pan can be utilized for panning and backpanning in accordance with the present invention while the other pan and classifying screens can be utilized for classification of material to be panned. For purposes of this description, however, only a single pan is shown and described, while it is understood that two pans are preferably employed.

Still referring to FIGS. 1, 2, and 3, the pan 20 comprises a rectangular base 34, side panels 36 and 38, front panel 40, rear panel 42, and handle 44. The rectangular base 34 has its longitudinal extent or dimension in the fore and aft direction relative to the entire pan; that is, the longest dimension of the rectangular base runs from the front panel 40 to the rear panel 42. The side panels 36 and 38 extend upwardly and outwardly in a divergent manner from the base 34. The bottom edge portions of the side panels 36 and 38 are joined to the side edge portions of the base 34 in rounded corner junctions. The front panel 40 extends upwardly and forwardly from its junction with the forward edge portion of the base 34. Extending upwardly from the rounded corner junction with the base 34 the front panel 40 has an increasing transverse dimension corresponding to the divergency of the side panels 36 and 38. In this manner the side edge portions of the front panel 40 are joined to the forward edge portions of the side panels 36 and 38 in rounded corner junctions. Similarly, the rear panel 42 extends upwardly and rearwardly from the rearward edge portion of the base 34. The bottom edge portion of the rear panel 42 is joined in a rounded corner junction to the rear edge portion of the rectangular base 34. The transverse dimension of the rear panel 42 also increases with increasing distance from the base 34 corresponding to the increased distance between the side panels 36 and 38. Thus, the side edge portions of the rear panel 42 are joined to the rear edge portions of the side panels 36 and 38 in rounded corner junctions. The handle 44 extends rearwardly from adjacent the upper edge of the rear panel 42. The central portion of the rear panel 42 is shaped so that it forms a trough 46 that extends upwardly and rearwardly from the base 34. The side and bottom walls of the handle 44 also define an upwardly opening trough 48 into which the rear panel trough 46 merges. The handle trough 48 extends rearwardly from the upper edge of the rear panel 42 and terminates in the rear wall of the handle. The rear wall of the handle carries an aperture 50 adjacent the bottom portion of the trough so that liquid residing in the trough can be emptied therefrom without requiring it to be spilled over the rearward edge of the handle 44. The purpose and function of the troughs 46, 48, and aperture 50 will be described in greater detail below.

The front panel is scalloped into a plurality of ridges 60,62,64,66, 68, and 70 and valleys 72,74,76,78,80, and 82. The lowermost valley is formed at the intersection of the forward edge portion of the base 34 and the lower face or surface of the first ridge 60. The second valley, 74, is formed by the upper face or surface of ridge 60 and the lower face or surface of ridge 62. Subsequent valleys 76 through 82 are formed by the respective upper and lower surfaces of adjacent ridges. The valleys and ridge lines are all parallel to each other. All of the ridges and valleys are transversely oriented across the front panel 40 and substantially orthogonally oriented with respect to the corner junctions between the side panels 36 and 38 and the base 34. The ridge and valley structure and their orientation relative to the base and sidewalls is important in both panning and backpanning as will be understood in more detail later. Most preferably, the bottom surfaces of the ridges 60 through 70 are oriented generally orthogonally but tilted slightly forwardly in relation to the base 34. Similarly, the upper surfaces of the ridges are oriented generally orthogonally but slightly upwardly sloping from the ridge towards the next valley.

A plurality of shoulders 86*a* and *b*, 88*a* and *b*, and 90*a* and *b* having upwardly facing surfaces extend in generally parallel relationship with each other and parallel relationship with the corner junction between the side panels 36 and 38 and the base 34. The sets of shoulders each lie in a plane that is generally parallel to the base 34. Each is spaced at varying heights from the base 34 and has increasing exterior dimensions in proportion to the increased distance from the base 34. The shoulders 86*a* and *b*, 88*a* and *b*, and 90*a* and *b* also extend partially across the forwardly facing surface of rear panel 42 and terminate adjacent the trough 46, with the exception of bottommost shoulder 86*a* which extends completely across the rear panel 42. Also, the shoulders 86*a* and *b*, 88*a* and *b*, and 90*a* and *b* form rearward extensions of the upper surfaces of ridges 62, 66, and 70 situated on the front panel 40. Thus, the upper surfaces of ridges 62, 66, and 70 cooperate in conjunction with the shoulders 86*a* and *b*, 88*a* and *b*, and 90*a* and *b* to form tray supports. The uppermost edge of the tray, including the upper edges of the front panel 40, side panels 36 and 38, rear panel 42, and handle 44 are formed into a continuous, convex lip, which functions as a stiffener for the upper peripheral portion of the pan, as well as an additional tray support, as will be understood later.

Referring now to FIG. 1, the bottom tray 22 and the screen trays 26,28,30, and 32 are configured so that they stack respectively on top of each other inside the pan 20. That is, the exterior dimensions of the tray and screens correspond to the interior dimensions at corresponding nesting locations within the pan 20. Thus, the tray 22, which comprises a side frame 94 and a solid bottom 96, rests on the upper surface of base 34. The dimensions of frame 94 are slightly less than the interior dimensions of the front, rear, and side panels adjacent the base 34. The lowermost screen tray 26 has a side frame 98 that generally conforms to the interior shape of the pan in the region immediatly above the base 34. The side frame 98 carries a peripheral indented shoulder halfway between its lower edge and upper edge, the shoulder 100 has a downwardly facing surface that mates with the upwardly facing surface of shoulders 86*a* and *b* and the upper surface of ridge 62 in the pan. Thus, the pan shoulder and frame shoulder 100 cooperate to support the screen frame 98 and at a location immediately above the bottom tray 22. A screen 102 is adhesively affixed to the bottom edge of the frame 98. Similarly, screen tray 28 comprises frame 104, support shoulder 106, and screen 108. The screen 108 is adhesively bonded to the bottommost edge portion of the frame 104. Again, the frame 104 is configured to conform to that portion of the interior surfaces of the pan immediately above the nesting location of screen tray 28. The bottom facing surface of the shoulder 106 is sized to conform with the shoulders 88*a* and *b* and the upper surface of ridge 66. Thus, the shoulder 106 and the shoulders 88*a* and *b* and upper surface of ridge 66 cooperate to support the screen 28 immediately above screen 26 within the pan. Similarly, screen tray 30 comprises frame 110, having supporting shoulder 112 and a screen 114 adhesively affixed to the bottom edge of the frame 110. Again, frame 110 is sized to fit inside the portion of the pan immediately above the location where screen tray 28 rests. The shoulder 112 and shoulders 90*a* and *b* and the upper surface tray of ridge 70 cooperate to support the screen 30 in that position. The uppermost screen 32 has a frame 116 with a rearwardly extending handle 118 and an upwardly convex peripheral lip 120. A screen 122 is also adhesively bonded to the bottom edge of the frame 116. The frame 116 is sized to fit within the pan 20 adjacent the upper peripheral edge of the pan while the lip 120 of the upper screen tray 32 is sized to extend over the upper edge of the pan and thus support the upper screen tray 32 adjacent the upper edge of the pan and immediately above the screen tray 30.

Thus, the bottom tray 22 has the smallest exterior dimensions of the trays 22 through 32. Each of the screens has an increasing exterior dimension in proportion to their spacing from the base 34 of the pan. Also, the size of the opening in the screen increases with increasing distance from the base 34 of the pan. An exemplary set of mesh sizes for the screens 102, 108, 114, and 122 is No. 40, No. 20, No. 10, and ¼" U.S. Standard mesh, respectively.

A collapsible bottle 24 has relatively planar upper and lower surfaces with collapsible, accordian-type sides. The bottle is generally rectangularly shaped in cross section and has an increasing peripheral dimension midway between the bottom and top panels. A removable cap and spout structure are integrated into one of the ends of the bottle. The use of the collapsible bottle will be described in greater detail below.

Use and operation of the panning and classifying system will now be discussed. First, the optional classifying procedures employing the screens of the present invention as well as a second pan will be discussed, followed by the panning and backpanning techniques employed with the pan 20 of the present invention.

Many times it is desired to use the panning technique and gravity separation to separate gold from a mass of material having a wide variety of grain sizes, from pebbles and rocks down to very fine sand and gold dust. Although classification per se, is old in the art, it has not heretofore been applied on a small scale to gold panning. The classification screens forming part of the panning and classifying system of the present invention are utilized to separate material to be panned into five fractions of varying sizes from very fine material to the very coarse. Referring to FIG. 4, the four classification trays 26, 28, 30, and 32 are positioned in a pan 20. Material to be classified, schematically indicated by the dashed line 124, is then placed on the uppermost screen 122 forming part of the screen tray 32. The pan 20 and classification trays 26 through 32 are then simultaneously vibrated so that the material 150 travels successively through the screens having successively smaller openings, leaving the coarser material 124*a* at the top and graduating the material into graduated size masses 124*b*, 124*c*, 124*d*, and 124*e*, which rest on the screen trays 32, 30, 28, 26, and pan bottom 34, respectively. Each of these masses then contain particles having generally the same size and can then be separately panned in a separate pan in accordance with the panning and backpanning techniques now to be described.

Figure 5:
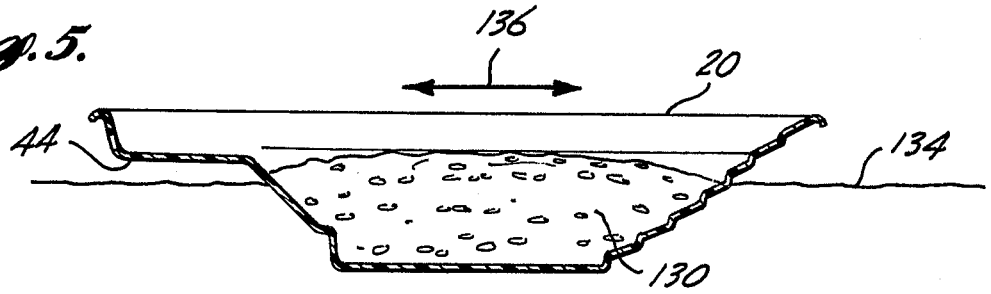
Figure 6:
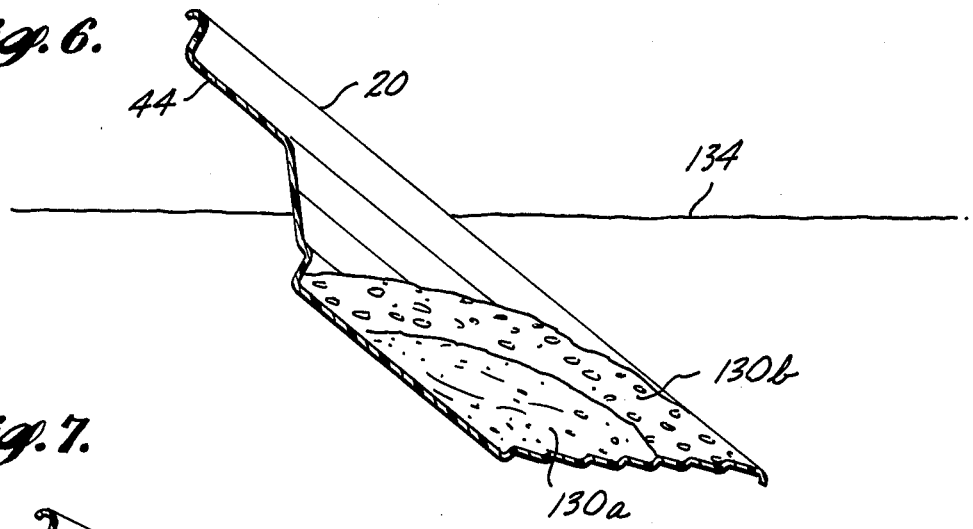
Figure 7:
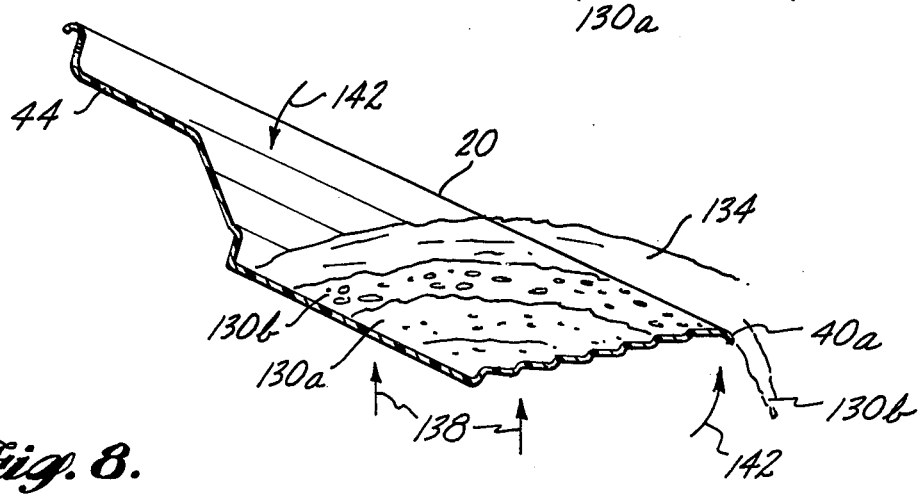

Referring first to FIG. 5, gold-containing sand and gravel mixture 130 is placed in the pan 20. The sand and gravel can be preclassified if desired. As now described in conjunction with FIGS. 5 through 8, a panning technique not necessarily requiring preclassification will be described. Sufficient water to cover the sand and gravel mixture 130 is also placed in the pan. If desired, the pan can be partially floated in the water 134 of the stream from which the gravel and sand were taken. The material should then be loosened and stirred in the pan. Normally one's fingers are used, employing a stirring and agitating technique so that the denser gold will travel toward the bottom of the pan. Any large rocks and pebbles can easily be separated from the top of the mixture by hand. Thereafter, the pan is positioned in the stream water 134, as illustrated in FIG. 5, and is vibrated back and forth in the direction of arrow 136 to cause the denser material 130*a* to sink toward the bottom of the pan. The pan is then tilted, as illustrated in FIG. 6, so that the material 130 in the pan slides toward the front of the pan. In this position, the pan is tilted at approximately a 45° angle with the horizontal. The pan is then submerged in the water 134 so that the water level rises above the material level in the pan and approaches the forward end of the handle 44. Referring now to FIG. 7, the pan is then partially removed from the water in an upward direction as indicated by arrows 138. As the pan is partially removed from the water, it is also rotated in the direction indicated by arrows 140 and 142 so that the forward edge 40*a* of the pan is moved upwardly and the handle portion of the pan is moved relatively downwardly. As the pan is lifted and rotated, the water residing in the pan flows out of the pan over the lighter material 130*b*, washing some of the lighter material 130*b* with it. The pan is lifted and simultaneously rotated until it is almost 20° to 30° from the horizontal as shown in FIG. 8.

Figure 8:
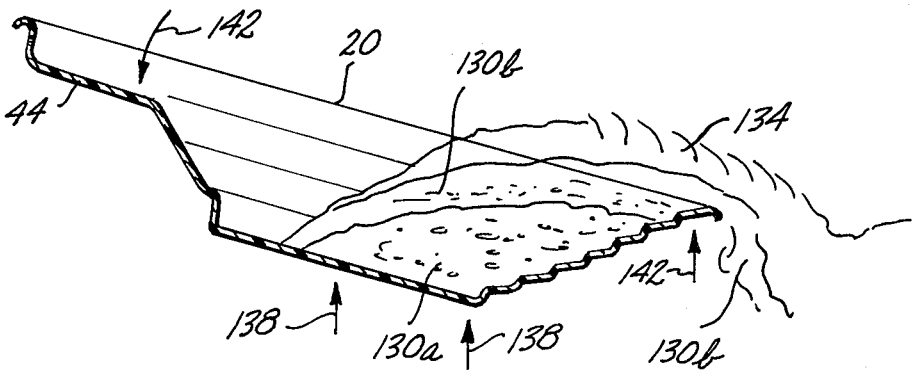

When removing the pan from the water and rotating it in the manner described in conjunction with FIGS. 6, 7, and 8, care should be taken so that the denser material at the bottom of the pan does not move. Care must be taken to only allow the less dense surface material 130*b* to slide over the forward edge 40*a* of the pan as the pan is rotated. The steps of submerging the pan, stirring the material with one's fingers, vibrating the pan, and washing the sand and gravel overburden from the more dense material in the pan by submersion, lifting and rotation of the pan, as just described are repeated several times until only the finest sand, usually referred to as "black sand" and gold remain in the pan. Care must also be taken that the vibration and washing steps are not conducted too vigorously. If, for example, the pan is removed from the water too quickly as it is being rotated as described in conjunction with FIGS. 6 through 8, too much sand and gravel, and perhaps some fine sand and gold will be washed out of the pan. Thus, only a small portion of the sand and gravel overburden should be removed with each successive cycle of the process. Normally, when all of the less dense material, with the exception of the black sand, is removed, from the pan, the black sand and gold mixture will reside only in the bottom valley or bottommost few valleys of the pan. At this point, one is ready to employ the backpanning technique of the present invention.

At this juncture, attention is called to a significant advantage of the construction of the pan for the washing steps just described. Because the pan is generally rectangular in cross section and has flared side panels, the wash water as it travels from the pan does not converge on itself, but instead slightly diverges. Thus, the "pinching" problem encountered with prior rounded pans is eliminated.

Figure 9:
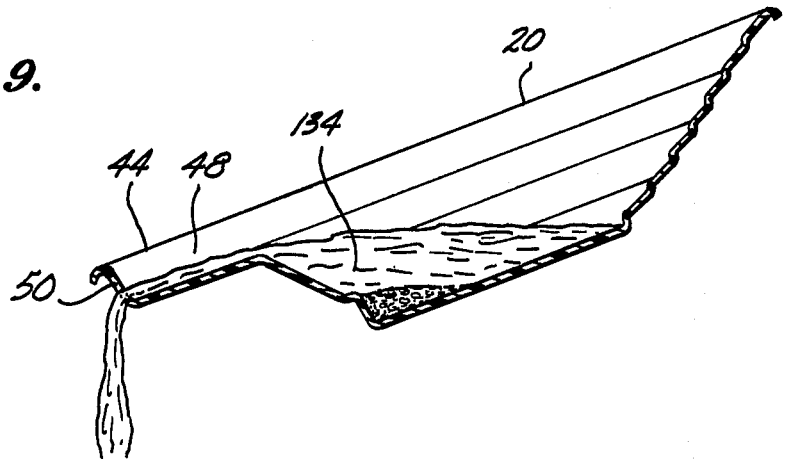
Figure 10:
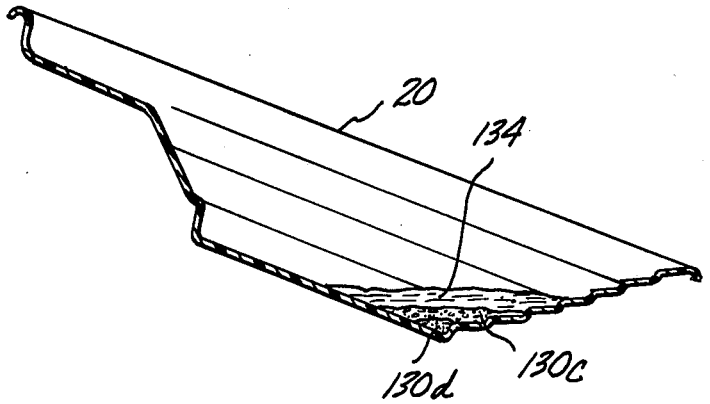

Referring to FIG. 9, to begin backpanning, a substantial portion of the water 134 in the pan is removed from the pan 20. This is accomplished by carefully tilting the pan so that the handle 44 is lowered relative to the forward portion of the pan 20. The material 130 in the bottom of the pan will roll back to the intersection between the base and back panel. The water, however, will traverse up the central trough (46 FIG. 2) and into the trough 48 (FIG. 2) in the handle 44 and will flow out of the aperture 50 in the rearward portion of the handle. All of the water 132 in the pan should be removed with the exception of an amount equivalent in volume to the amount of black sand and gold left in the pan. Thereafter, the pan is tilted forwardly, that is, so the handle is raised above the forward edge 40*a* of the pan as shown in FIG. 10. The pan is then vibrated so that all of the black sand and gold in the pan resides in the lowermost valley or two formed in the front panel 40. At this step in the process, substantially all of the gold 130*d* should have settled to the bottom of the black sand, 130*c*, leaving only black sand overlying the gold. The backpanning technique is intended to carefully and efficiently remove the black sand layer, leaving only the gold in the valleys.

Figure 11:
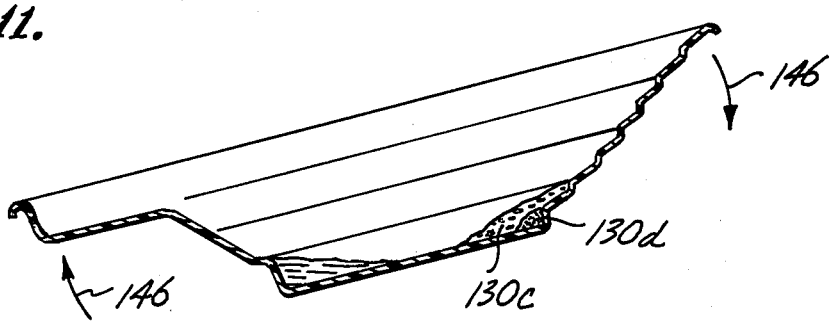
Figure 12:
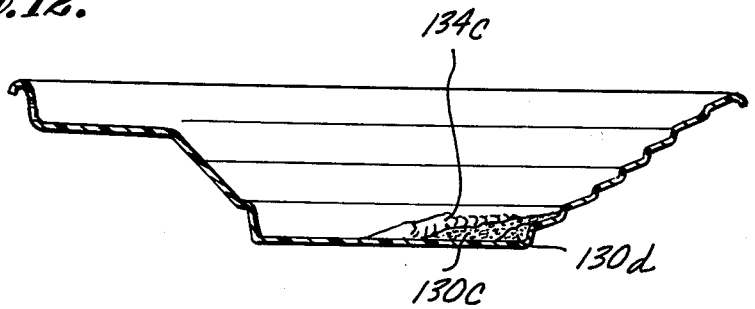
Figure 13:
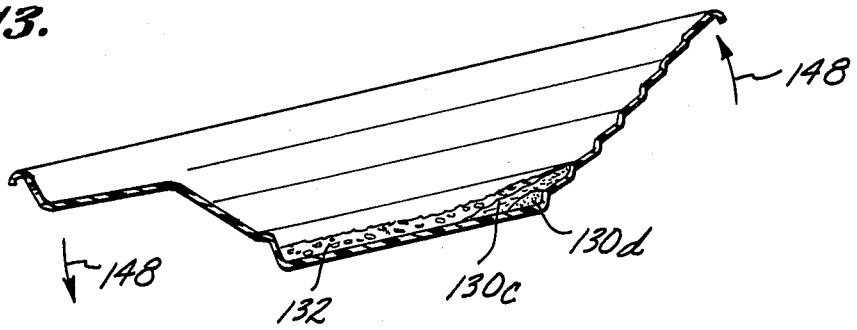
Figure 14:
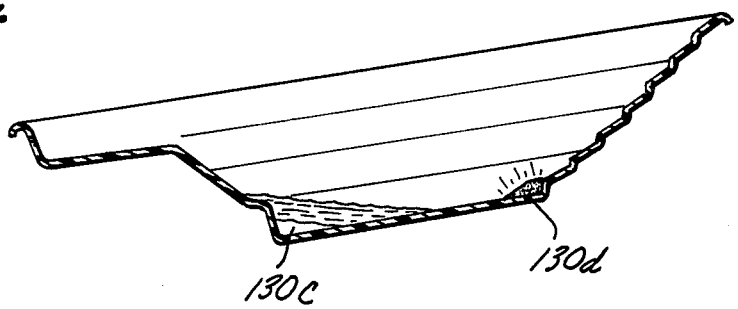
Figure 15:
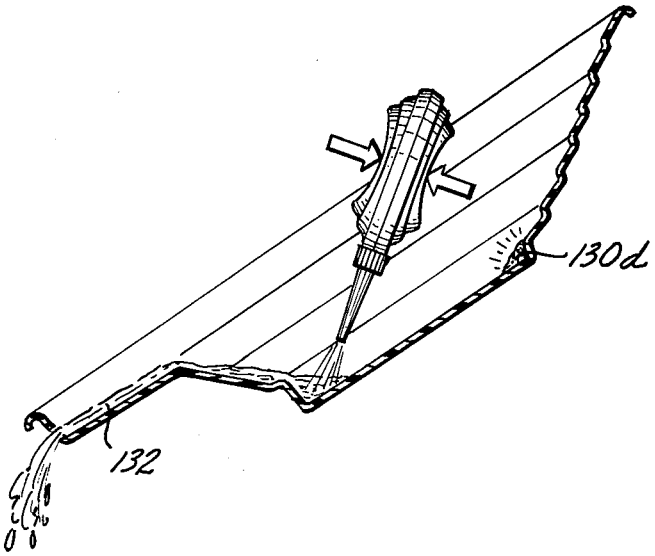

Referring to FIG. 11, backpanning is initiated by carefully rocking the pan backwardly so that the water resides in the trough formed by the base and the back panel of the pan. Care is taken so that the gold 130*d* and black sand 130*c* is left in the valleys formed by the forward panel as shown in FIG. 11. Thereafter, the pan is carefully rocked forwardly in the direction indicated by arrows 146 (FIG. 11) so that the water flows from the back portion of the pan toward the forward portion and over the black sand 130*c* in the pan. The water travels forwardly in a uniformly deep wave 134*a*, as shown in FIG. 12, and is caused to flow across the entire surface of the black sand 130*c*. As soon as the wave front has reached the forwardmost portion of the black sand surface, the pan is tilted rearwardly again in the direction of arrows 148 as indicated in FIG. 13. The water flows off the black sand mass in a uniformly deep layer and carries with it in suspended form a small portion of the black sand adjacent the surface of the black sand and gold mass 130. The rocking steps are repeated until all of the black sand 130*c* is removed from the gold 130*d* as indicated in FIG. 14. Referring to FIG. 15, the gold 130*d* then resides in the forwardmost valley of the pan, leaving the black sand 130*c* adjacent the back portion of the pan. The pan is then tilted backwardly so that water can flow up the trough 46 in the back panel and out through the aperture 50 in the back portion of the handle. Wash water is then supplied to the pan via, for example, a snuffer bottle, cup, or other means for the purpose of washing the black sand out of the back portion of the pan. In this manner, only gold is left in the forward, lowermost valley formed by the front panel of the pan. The gold can then be removed from the pan in a conventional manner. For example, a small amount of water can be added to the gold in an amount sufficient to fluidize the gold. The gold can then be sucked into a second gold-retaining snuffer bottle.

The backpanning technique is extremely successful because of the way the black sand and gold and water are confined within the lower portion of the pan. Because the bottom has a rectangular shape, as opposed to a round or circular prior art shape, and because the forward panel is oriented in essence orthogonally to the longitudinal dimension of the rectangular base, the water travels in a uniformly deep wave front in the transverse dimension relative to the pan (or the longitudinal dimension of the black sand and gold mass in the front of the pan), and also travels over the surface of the black sand and gold mass in a uniform front. Similarly, as the water flows off the black sand and gold mass it travels in a wave front that is uniformly deep in the transverse direction. In this manner, the pinching effect observed with prior art round gold pans is eliminated allowing the black sand to be uniformly removed across the entire surface of the black sand and gold mass.

Thus, it can be seen that the panning and classifying system and methods of the present invention fulfill the objects set forth at the beginning of the specification. Although the present invention is disclosed in conjunction with preferred embodiments thereof, one of ordinary skill will be able to effect various changes, substitutions of equivalents, and other alterations without departing from the broad concepts imparted herein. Accordingly, it is intended that the scope of protection granted by Letters Patent hereon be limited only by the definition contained in the appended claims and equivalents thereof.

I claim:

1. A container for separation of a first granular material from a second granular material having a specific gravity less than said first granular material comprising:

a generally rectangular base portion having a forward end and a rearward end, the longitudinal dimension of said base lying in the fore and aft direction of said base, a pair of side panels joined to and extending divergently upwardly from opposite longitudinal sides of said base, a front panel joined to and extending upwardly and forwardly from the forward end of said base, said front panel increasing in width as it extends upwardly in proportion to the divergency of said side panels, the forward edge portions of said side panels being joined to respective ones of the side edge portions of said front panel, said front panel having a plurality of ridges and valleys extending thereacross, each of said valleys having a substantially constant depth relative to an adjacent ridge, the ridge lines of said ridges being substantially parallel to each other and substantially parallel to the corner junction between said front panel and said base, and a rear panel extending upwardly from the rearward edge of said base, said rear panel increasing in width as it extends upwardly in proportion to the divergency of said side panels, the side edge portions of said rear panel being joined to respective rearward edge portions of said side panels.

2. The container of claim 1 wherein said plurality of ridges and valleys extend serially from adjacent said base to adjacent the upper edge of said front panel.

3. The container of claim 2 wherein each of said ridges comprises a first portion oriented in a generally parallel relationship with said base and a second portion oriented transversely to said first portion, said first and second portions joined to each other along a ridge line, the first portion of said ridge adjacent said base and said base being joined to form the lowermost valley, the first portion of successive ridges and the second portion of an adjacent ridge forming the remainder of said valleys.

4. The container of claim 3 wherein said second portions are oriented substantially parallel to each other and said first portions are oriented substantially parallel to each other, each said second portion being joined to adjacent first portions in smoothly rounded corner junctions, said first portion adjacent said base being joined thereto in a smoothly rounded corner junction.

5. The container of claim 1 wherein said side panels have a plurality of sets of shoulders on the opposing inner sides thereof, said shoulders having upwardly facing surfaces thereon, said shoulders having inner edges that are oriented substantially parallel to said base, the inner edges of each set of shoulders being spaced from said base by a distance corresponding to the spacing from said base of one of said ridges on said front panel and being joined with the corresponding one of said ridges on said front panel so as to form an extension thereof along said side panels.

6. The container of claim 5 wherein said upper surfaces of said shoulders are substantially parallel to said base.

7. The container of claim 6 wherein said plurality of sets of shoulders corresponds to alternate ones of said ridges on said front panel.

8. The container of claim 5 wherein said rear panel has shoulders corresponding to and forming extensions of said sets of shoulders on said side panels.

9. The container of claim 8 wherein said rear panel has a central trough portion extending upwardly from adjacent said base to adjacent the upper edge thereof, said shoulders on said rear panel being discontinuous in the region of said trough.

10. The container of claim 9 further comprising a handle joined to and extending rearwardly from said rear panel at a location adjacent the upper edge thereof, said handle having a rearwardly extending trough portion therein joined to the trough portion in said rear panel.

11. The container of claim 1 wherein said rear panel has a central trough portion extending upwardly from adjacent said base toward the upper edge of said rear panel.

12. The container of claim 11 further comprising a handle joined to and extending rearwardly from said rear panel at a location adjacent the upper edge thereof, said handle having a rearwardly extending trough portion therein joined to the trough portion in said rear panel.

13. The container of claim 1 wherein said side panels and said base meet to form substantially parallel edge corner junctions.

14. The container of claim 13 wherein said front panel and said base meet to form a front corner junction that is oriented substantially orthogonally to said edge corner junctions.

15. The container of claim 14 wherein said rear panel and said base meet to form a rear corner junction that is oriented substantially orthogonally to said edge corner junctions.

16. A panning and classifying system for classifying granular material and for separating at least a first granular material from a second granular material having a specific gravity less than said first material comprising a pan having a rectangular base, upwardly diverging side panels, an upwardly and forwardly extending front panel, and an upwardly and rearwardly extending back panel all constructed and joined so as to form an upwardly opening container, said back panel having a rearwardly extending handle connected thereto, said front panel having a plurality of spaced ridges and valleys therein, said ridge line extending across said front panel being in generally parallel relationship to the junction of said front panel and said base, at least one of said rear panel and said side panels having a plurality of traysupporting shoulders thereon, said tray-supporting shoulders being oriented generally parallel to said base, said tray-supporting shoulders being spaced from said base by distances corresponding to the distances that at least some of said ridge lines are spaced from said base so that said ridges and said shoulders cooperate to form a plurality of tray supports, the tray support nearest said base having the smallest exterior dimensions, the tray supports having increasing exterior dimensions in proportion to their increased spacing from said base, a plurality of trays sized to rest in nesting relationship on said plurality of tray supports said trays including a tray frame and a bottom screen, the tray nearest said base having a bottom screen with the smallest screen openings, the openings in said screens of the remaining trays having an increased size in proportion to the respective increase in spacing of said remaining trays from said base.

17. The system of claim 16 further comprising a bottom tray that rests on the bottom of said pan, said bottom tray having a solid bottom.

18. The system of claim 16 further comprising a collapsible snuffer bottle resting on at least one of said trays.

19. The system of claim 16 wherein said shoulders are located on said side panels and extend across at least a portion of said back panel.

20. The system of claim 16 wherein said uppermost tray has a handle extending rearwardly therefrom in generally parallel relationship to the handle on said pan.

21. The system of claim 16 wherein the fore and aft dimension of said pan is its longitudinal dimension.

22. The system of claim 16 wherein said side panels and said base meet to form substantially parallel corner junctions.

23. The system of claim 22 wherein said front panel and said base meet to form a rounded corner junction that is oriented substantially orthogonally to said edge corner junctions.

24. A method for separating a mixture of a first granular material and a second granular material having a specific gravity less than that of the first material comprising the steps of confining said mixture in a trough-like container in an elongated mass having a relatively flat upper surface and a longitudinal axis, covering said mixture with water and vibrating said container to cause said first material to settle toward the bottom of said trough-like container, leaving the second material adjacent the flat upper surface thereof, confining said water over and adjacent said mixture so that, as said container is moved, the water passes over said mass in a direction generally orthogonal to the longitudinal axis of said mass, said water alternately running off said mass in a layer having a uniform depth along the longitudinal extent of said mass, and running over said mass in a layer having a relatively uniform depth along the longitudinal extent of said mass, said water as it runs off said mass carrying at least a portion of said second material from the top of said mass.

25. A container for separation of a first granular material from a second granular material having a specific gravity less than said first granular material comprising:

a rectangular base portion having a forward end and a rearward end, the longitudinal dimension of said base lying the fore and aft direction of said base, side panels joined to and extending divergently upwardly from opposite longitudinal sides of said base, said side panels and said base meeting to form parallel edge corner junctions, a front panel joined to and extending upwardly and forwardly from the forward end of said base, said front panel increasing in width as it extends upwardly in proportion to the divergency of said side panels, the forward edge portions of said side panels being joined to respective ones of the side edge portions of said front panel, said front panel and said base meeting to form a front corner junction that is oriented orthogonally to said edge corner junctions, said front panel having at least one ridge extending thereacross spaced from but in parallel relationship to said front corner junction, and a rear panel extending upwardly from the rearward edge of said base, said rear panel increasing in width as it extends upwardly in proportion to the divergency of said side panels, the side portions of said rear panel being joined to respective rearward portions of said side panels, said rear panel and said base meeting to form a rear corner junction that is oriented orthogonally to said edge corner junctions.

* * * * *